US011035174B2

(12) United States Patent
Hardin, Jr.

(10) Patent No.: US 11,035,174 B2
(45) Date of Patent: Jun. 15, 2021

(54) STRATEGIC FLEXIBLE SECTION FOR A ROTARY STEERABLE SYSTEM

(71) Applicant: Halliburton Energy Services, Inc., Houston, TX (US)

(72) Inventor: John Ransford Hardin, Jr., Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/491,221

(22) PCT Filed: May 16, 2018

(86) PCT No.: PCT/US2018/033037
§ 371 (c)(1),
(2) Date: Sep. 5, 2019

(87) PCT Pub. No.: WO2018/222394
PCT Pub. Date: Dec. 6, 2018

(65) Prior Publication Data

US 2020/0080381 A1 Mar. 12, 2020

Related U.S. Application Data

(60) Provisional application No. 62/513,365, filed on May 31, 2017.

(51) Int. Cl.
*E21B 7/06* (2006.01)
*E21B 17/16* (2006.01)
*E21B 47/022* (2012.01)

(52) U.S. Cl.
CPC ..... *E21B 7/067* (2013.01); *E21B 7/061* (2013.01); *E21B 17/16* (2013.01); *E21B 47/022* (2013.01)

(58) Field of Classification Search
CPC ... E21B 7/04; E21B 7/06; E21B 7/067; E21B 7/061; E21B 17/16; E21B 47/022
See application file for complete search history.

(56) References Cited

U.S. PATENT DOCUMENTS 4,683,952 A 8/1987 Peiffer et al.
4,699,224 A 10/1987 Burton
(Continued)

FOREIGN PATENT DOCUMENTS

CN 1139972 A 1/1997
CN 106471205 A 3/2017
(Continued)

OTHER PUBLICATIONS

China National Intellectual Property Administration, First Office Action and Search Report, dated Jun. 10, 2020, 7 pages, China.
(Continued)

*Primary Examiner* — Kristyn A Hall
*Assistant Examiner* — Dany E Akakpo

(57) ABSTRACT

A Rotary Steerable System (RSS) includes a flexible collar coupled therein or thereto that permits the stiffness of the RSS to be controlled and permits a desired turning radius to be achieved without sacrificing stability characteristics of the RSS. The flexible collar may be positioned between a steering section and the controller of the RSS. The parameters affecting the geometry, position and stiffness characteristics of the flexible collar and the RSS may be selected strategically to match the requirements of the particular wellbore being drilled. By selecting these parameters strategically, improvements may be achieved related to tool length, bending stiffness, bending stress, torsional stiffness, shear stress due to torsion and increased dogleg severity tolerance.

20 Claims, 7 Drawing Sheets

(56) References Cited

U.S. PATENT DOCUMENTS

| | | | | |
|---|---|---|---|---|
| 5,538,091 | A | 7/1996 | Theocharopoulos | |
| 5,857,531 | A | 1/1999 | Estep et al. | |
| 2005/0109542 | A1 | 5/2005 | Downton | |
| 2005/0150692 | A1* | 7/2005 | Ballantyne | E21B 7/062 175/61 |
| 2006/0283635 | A1 | 12/2006 | Moody et al. | |
| 2007/0163810 | A1 | 7/2007 | Underwood et al. | |
| 2011/0067925 | A1 | 3/2011 | Underwood et al. | |
| 2014/0309978 | A1* | 10/2014 | Chen | E21B 44/00 703/7 |
| 2015/0337640 | A1 | 11/2015 | Huang et al. | |
| 2015/0368975 | A1 | 12/2015 | Zupanick | |
| 2016/0312598 | A1 | 10/2016 | Samuel et al. | |

FOREIGN PATENT DOCUMENTS

| | | | |
|---|---|---|---|
| GB | 2445019 | A | 6/2008 |
| RU | 2114273 | C1 | 7/2007 |
| SU | 1286728 | A1 | 1/1987 |
| WO | WO 2018/085042 | A1 | 5/2018 |

OTHER PUBLICATIONS

Russian Patent Office, Search Report, dated Apr. 8, 2020, 2 pages, Russia.

International Search Report and the Written Opinion of the International Search Authority, or the Declaration, dated Sep. 10, 2018, PCT/US2018/033037, 11 pages, ISA/KR.

European Patent Office, Partial Supplementary European Search Report, Application No. 18809597.0, dated Feb. 23, 2021, 15 pages, Europe.

* cited by examiner

| Material | OD [in] | ID [in] | Length of Flex [in] | E [X $10^6$ psi] | I [$in^4$] | E X I [X $10^6$ psi $in^4$] | G [X $10^6$ psi] | J [$in^4$] | G X J [X $10^6$ psi $in^4$] |
|---|---|---|---|---|---|---|---|---|---|
| Titanium | 4.50 | 3.50 | 55.531 | 13.9* | 12.8 | 177.4 | 5.3 | 25.5 | 134.4 |
| Steel | 3.75 | 2.00 | 55.531 | 29.0 | 8.9 | 258.7 | 11.2 | 17.8 | 200.6 |
| Ratio Ti/Stl | 1.20 | 1.75 | 1.0 | 0.48 | 1.43 | 0.69 | 0.47 | 1.43 | 0.67 |

STRATEGIC FLEXIBLE SECTION FOR A ROTARY STEERABLE SYSTEM

The present application is a U.S. National Stage patent application of International Application No. PCT/US2018/033037, filed on May 16, 2018, which claims priority to U.S. Provisional Application No. 62/513,365 filed May 31, 2017 both entitled "Strategic Flexible Section for a Rotary Steerable System," the disclosures of which are hereby incorporated by reference in their entirety.

BACKGROUND

The present disclosure relates generally to rotary steerable systems (RSS), e.g., drilling systems employed for directionally drilling wellbores in oil and gas exploration and production. More particularly, embodiments of the disclosure relate to rotary steerable systems having flexible collar therein for achieving a desired steering radii.

Directional drilling operations involve controlling the direction of a wellbore as it is being drilled. Usually the goal of directional drilling is to reach a target subterranean destination with a drill string, and often the drill string will need to be turned through a tight radius to reach the target destination. Generally, an RSS changes direction either by pushing against one side of a wellbore wall with steering pads to thereby cause the drill bit to push on the opposite side (in a push-the-bit system), or by bending a main shaft running through a non-rotating housing to point the drill bit in a particular direction with respect to the rest of the tool (in a point-the-bit system). In a push-the-bit system, the wellbore wall is generally in contact with the drill bit, the steering pads and a stabilizer. The steering capability of such a system is predominantly defined by a curve that can be fitted through each of the drill bit, steering pads and the stabilizer.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure includes an RSS having a flexible collar coupled therein that permits a desired turning radius to be achieved. The flexible collar may be positioned at an up-hole end of a bottom hole assembly including an RSS, or alternatively, the flexible collar may be positioned between a steering section and the controller of the RSS. The parameters affecting the geometry and stiffness characteristics of the flexible collar may be selected strategically to match the requirements of the particular wellbore being drilled. Also, a drill bit for the rotary steerable system may be selected such that a side cutting efficiency of the drill bit, together with the placement and stiffness characteristics of the flexible collar, may be selected strategically to match the requirements of the particular wellbore being drilled. By selecting these parameters strategically, improvements related to tool length, bending stiffness, bending stress, torsional stiffness, shear stress due to torsion and increased dogleg severity tolerance may be obtained.

Figure 1:
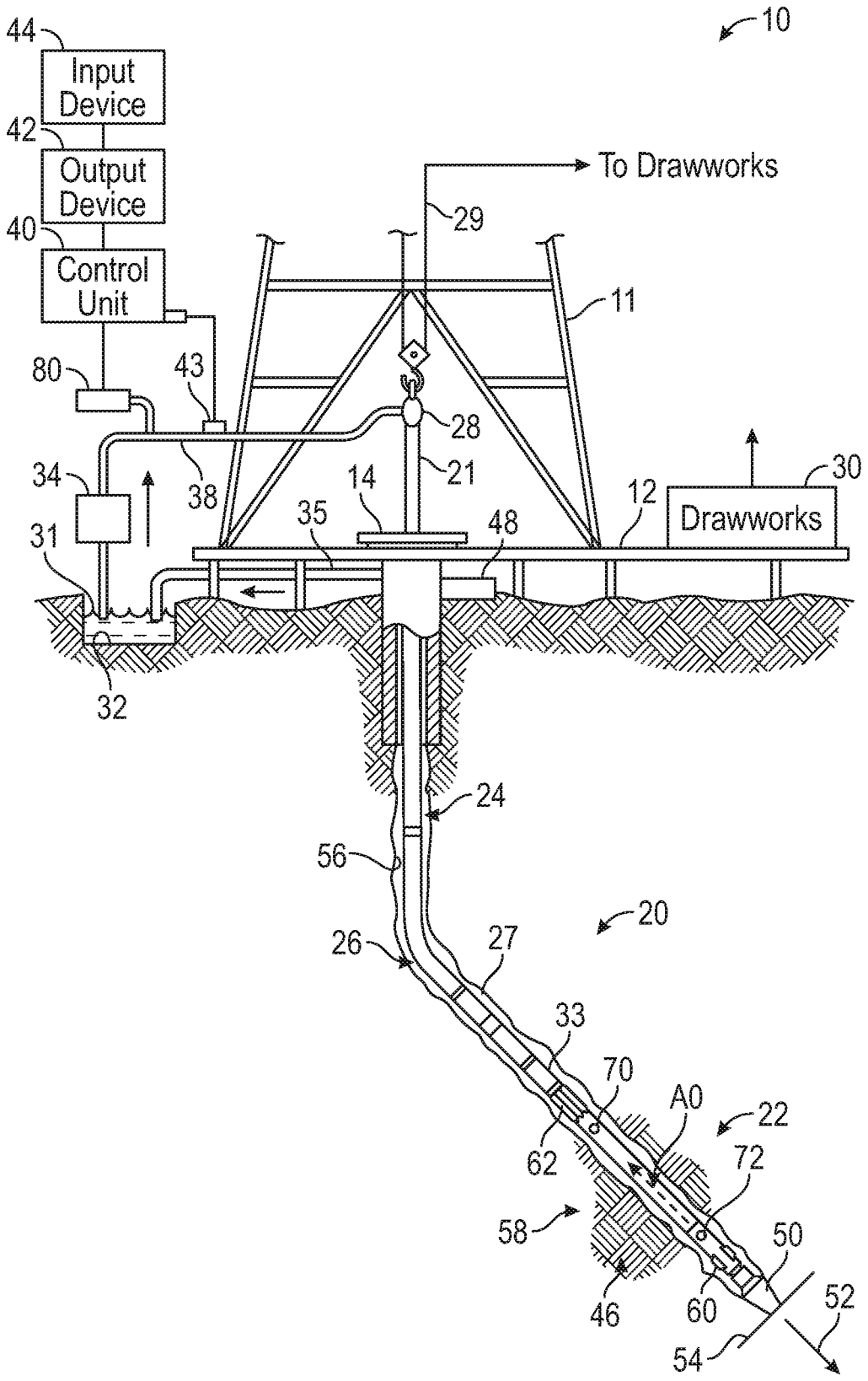
FIG. 1 is a partial cross-sectional side view of a directional wellbore drilled with a bottom hole assembly including an RSS.

FIG. 1 is a partial cross-sectional side view of a directional wellbore drilled with a bottom hole assembly (BHA) including an RSS. An exemplary directional drilling system 10 is illustrated including a tower or "derrick" 11 that is buttressed by a derrick floor 12. The derrick floor 12 supports a rotary table 14 that is driven at a desired rotational speed, for example, via a chain drive system through operation of a prime mover (not shown). The rotary table 14, in turn, provides the necessary rotational force to a drill string 20. The drill string 20, which includes a drill pipe section 24, extends downwardly from the rotary table 14 into a directional wellbore or borehole 26. The borehole 26 may exhibit a multi-dimensional path or "trajectory." The three-dimensional direction of the bottom 54 of the borehole 26 of FIG. 1 is represented by arrow 52.

A drill bit 50 is attached to the distal, downhole end of the drill string 20. When rotated, e.g., via the rotary table 14, the drill bit 50 operates to break up and generally disintegrate the geological formation 46. The drill string 20 is coupled to a "drawworks" hoisting apparatus 30, for example, via a kelly joint 21, swivel 28, and line 29 through a pulley system (not shown). During a drilling operation, the drawworks 30 can be operated, in some embodiments, to control the weight on drill bit 50 and the rate of penetration of the drill string 20 into the borehole 26.

During drilling operations, a suitable drilling fluid or "mud" 31 can be circulated, under pressure, out from a mud pit 32 and into the borehole 26 through the drill string 20 by a hydraulic "mud pump" 34. Mud 31 passes from the mud pump 34 into the drill string 20 via a fluid conduit (commonly referred to as a "mud line") 38 and the kelly joint 21. Drilling fluid 31 is discharged at the borehole bottom 54 through an opening or nozzle in the drill bit 50, and circulates in an "uphole" direction towards the surface through an annular space 27 between the drill string 20 and the side 56 of the borehole 26. As the drilling fluid 31 approaches the rotary table 14, it is discharged via a return line 35 into the mud pit 32. A variety of surface sensors 48, which are appropriately deployed on the surface of the borehole 26, operate alone or in conjunction with downhole sensors 70, 72 deployed within the borehole 26, to provide information about various drilling-related parameters, such as fluid flow rate, weight on bit, hook load, etc.

A surface control unit 40 may receive signals from surface and downhole sensors (e.g., sensors 48, 70, 72) and devices via a sensor or transducer 43, which can be placed on the fluid line 38. The surface control unit 40 can be operable to process such signals according to programmed instructions provided to surface control unit 40. Surface control unit 40 may present to an operator desired drilling parameters and other information via one or more output devices 42, such as a display, a computer monitor, speakers, lights, etc., which may be used by the operator to control the drilling operations. Surface control unit 40 may contain a computer, memory for storing data, a data recorder, and other known and hereinafter developed peripherals. Surface control unit 40 may also include models and may process data according to programmed instructions, and respond to user commands entered through a suitable input device 44, which may be in the nature of a keyboard, touchscreen, microphone, mouse, joystick, etc.

In some embodiments of the present disclosure, the rotatable drill bit 50 is attached at a distal end of a bottom hole assembly (BHA) 22 comprising a rotary steerable system (RSS) 58. In the illustrated embodiment, the BHA 22 is coupled between the drill bit 50 and the drill pipe section 24 of the drill string 20. The BHA 22 and or/the RSS 58 may comprise a Measurement While Drilling (MWD) System, with various sensors, e.g., sensors 70, 72, to provide information about the formation 46 and downhole drilling parameters. The MWD sensors in the BHA 22 may include, but are not limited to, a device for measuring the formation resistivity near the drill bit, a gamma ray device for measuring natural radioactivity of the formation 46, devices for determining the inclination and azimuth of the drill string 20, and pressure sensors for measuring drilling fluid pressure downhole. The MWD sensors may also include additional/alternative sensing devices for measuring shock, vibration, torque, telemetry, etc. The above-noted devices may transmit data to a downhole communicator 33, which in turn transmits the data uphole to the surface control unit 40. In some embodiments, the BHA 22 may also include a Logging While Drilling (LWD) System.

A transducer 43 can be placed in the mud supply line 38 to detect mud pulses responsive to the data transmitted by the downhole communicator 33. The transducer 43 in turn generates electrical signals, for example, in response to the mud pressure variations and transmits such signals to the surface control unit 40. Alternatively, other telemetry techniques such as electromagnetic and/or acoustic techniques or any other suitable techniques known or hereinafter developed may be utilized. By way of example, hard wired drill pipe may be used to communicate between the surface and downhole devices. In another example, combinations of the techniques described may be used. A surface transmitter/receiver 80 communicates with downhole tools using, for example, any of the transmission techniques described, such as a mud pulse telemetry technique. This can enable two-way communication between the surface control unit 40 and the downhole communicator 33 and other downhole tools.

The BHA 22 and/or RSS 58 can provide some or all of the requisite force for the bit 50 to break through the formation 46 (known as "weight on bit"), and provide the necessary directional control for drilling the borehole 26. The RSS 58 may include a steering section with steering pads 60 extendable in a lateral direction from a longitudinal axis AO of the RSS 58 to push against the geologic formation 46. The steering pads 60 may comprise hinged pads, arms, fins, rods, energized stabilizer blades or any other element extendable from the RSS 58 to contact the side 56 of the borehole 26. The steering pads 60 may be circumferentially spaced around the RSS 58, and may be individually extended to contact the side 56 of the borehole 26 to alter an angle of the longitudinal axis of the RSS 58 with respect to the borehole 26 while drilling and/or apply a side force to the drill bit 50. The steering pads 60 may include a set of at least three externally mounted steering pads 60 to exert force in a controlled orientation to deviate the drill bit 50 in the desired direction for steering. In some embodiments, the steering pads 60 are energized by a small percentage of the drilling fluid or mud 31 pumped through the drill string 20 and drill bit 50 for cuttings removal, cooling and well control. The RSS 58 is thereby using the "free" hydraulic energy of the drilling fluid or mud 31 for directional control. For traditional electrical servomotor/solenoid-type drive systems, the power requirement is in the order of 100-300 W. The steering pads 60 may provide an adjustable force or extension to assist in controlling the direction of the borehole 26. The RSS 58 also includes a stabilizer 62 coupled to a control section thereof.

Figure 2:
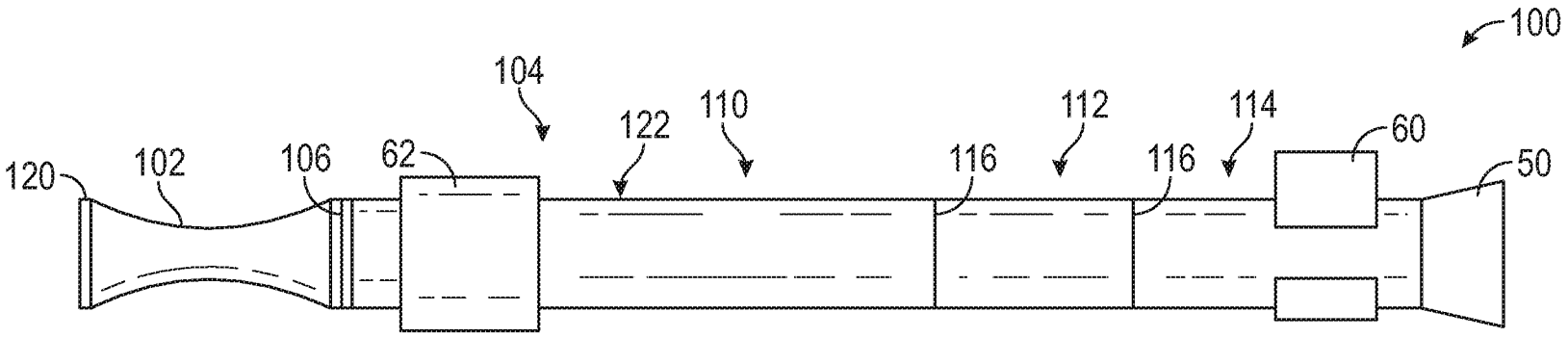
FIG. 2 is a schematic view of a bottom hole assembly including a flexible collar coupled to an up-hole end of an RSS.

FIG. 2 is a schematic view of a bottom hole assembly 100 including a flexible section or flexible collar 102 coupled to an up-hole end of an RSS 104. The flexible collar 102 may generally be constructed to exhibit a lower bending stiffness than the RSS 104 and other components of the BHA 100. The flexible collar 102 may include a structural connector 106 such as threads, latches, etc. at leading or downhole end thereof for selectively coupling to a trailing or uphole end of the RSS 104. The RSS 104 includes a control section 110, flow control section 112 and steering section 114, each of which may be packaged in a single housing with a greater bending stiffness than the flexible collar 102. Alternatively, structural connectors 116 may be provided between the control section 110, the flow control section 112 and the steering section 114. The flexible collar 102 may include a drill string coupler 120 at an uphole end thereof for coupling the BHA 100 to the drill pipe section 24 (FIG. 1) of the drill string 20. The bottom hole assembly 100 may then exhibit greater flexibility than the RSS 104 alone.

In other embodiments, the flexible collar 102 may positioned within the RSS (see FIG. 3) or at other locations within the drill string 20. When the flexible collar 102 is positioned within the RSS, the flexible collar 102 may include a structural connector 116, threads, latches, etc., at leading or downhole end thereof for selectively coupling to a trailing or uphole end of the steering section 114 of the RSS 104. In some embodiments the steering section 114 may contain the flow control section 112 (see FIG. 3A), e.g., the steering section 114 and the flow control section 112 may be housed together with no structural connector therebetween. The flexible collar 102 may also include a structural connector 116, threads, latches, etc. at trailing or uphole end thereof for selectively coupling to a leading or downhole end of the control section 110 of the RSS.

The flexible collar 102 may be strategically designed to achieve a desired dogleg severity (DLS) capability from the RSS 104 with a given placement of the flexible collar among the other components of the flexible collar 102. Geometric sizing, material selection, and the physical construction characteristics of composite or other non-metallic materials for the flexible collar 102 may be selected to enable the RSS 104 to meet specific capability requirements. Generally, sizing of the flexible collar 102 includes selecting an outer diameter (OD), an inner diameter (ID) and a length of the flexible collar. One material property considered for material selection is the Modulus of Elasticity (E). Another material property considered for material selection is the Modulus of Rigidity (G). The strategic sizing and material selection for the flexible collar 102 may be used to increase or maximize the DLS capability when desired, e.g., to drill a high DLS build, curve, drop or turn section of a wellbore 26 (FIG. 1). Similarly, the strategic sizing and material selection may be used to limit or minimize the DLS capability when desired, e.g., to drill a lower DLS build, drop or turn section, or to drill vertical, tangent, lateral, or horizontal sections of a well bore 26 in instances where a lower DLS capability is desired and/or where a high DLS capability may be problematic. Strategic sizing and material selection of the flexible collar 102 enables other attributes of the RSS 104 and flexible collar 102 to be optimized including: tool length, bending moment, bending stress, torsional stiffness, shear stress due to torsion, and increased DLS tolerance.

The drill bit 50 is coupled to the downhole end of the steering section 114, which includes a plurality of steering pads 60 or other pushing devices for steering the drill bit 50. The steering pads 60 may be constructed as hinged pad pushers, steering pistons or similar pistons such as those found on adjustable gauge stabilizers (not shown). The flow control section 112 is coupled above the steering section 114 (or comprises an uphole portion of the steering section 114), and is operable to divert a portion of the total drilling fluid or mud 31 (FIG. 1) pumped through the BHA 100. Typically, the flow control section 112 may include a valve set 210 (FIG. 3) that deviates about 1-4% from the main mud flow. The diverted portion passes through a filter element before being directed to the respective steering pad 60 or pushing device through flow paths defined in the steering section 114. The flow deviation is generally achieved using mechanically driven/controlled valve assemblies 210, but other arrangements are also contemplated such as a single rotating valve that distributes the diverted portion of the flow to the respective steering pad 60 or pushing device through flow paths defined in the steering section 114. In order to control and drive the mechanical valve assemblies 210, servo motor, gearbox and/or bearing assemblies are traditionally employed. These gearbox and/or bearing assemblies can require volume compensation systems, if oil filling is required, and sealing solutions to prevent the ingress of drilling fluid or mud 31.

The control section houses an electronics assembly 212 (FIG. 3A) including Directional and Inclination (D&I) sensor packages, Gamma Ray (GR) sensor packages, and others types of MWD or LWD sensors. The control section 110 may also include a CPU, power conditioning, and communication device (e.g., the downhole communicator 33 (FIG. 1)). Power generation and/or power supply components are also generally located inside the control section 110. The power generation and/or supply components need to be sufficiently sized to power the electronics assembly 212, drive the mechanical valve assemblies 210 or single rotating valve and overcome any frictional losses created by seals, bearings, gearboxes, etc., or the valve itself. The stabilizer 62 is coupled to an outer housing 122 of the control section 110.

The theoretical steering capability of the BHA 100 is generally defined by a curve that can be fitted through the stabilizer 62, steering pads 60 and drill bit 50. These are the components that generally contact the geologic formation 46 (FIG. 1) when forming the wellbore 26. Flexing of the control section 110, flow control section 112 and steering sections 114 can increase the steering response of the BHA 100 in operation, but flexing of these sections 110, 112, 114 is typically limited in order to prevent damage or disruption of the internal components of these sections 110, 112, 114, which could lead to a reduction in directional control accuracy (e.g., toolface control).

Figure 3A:
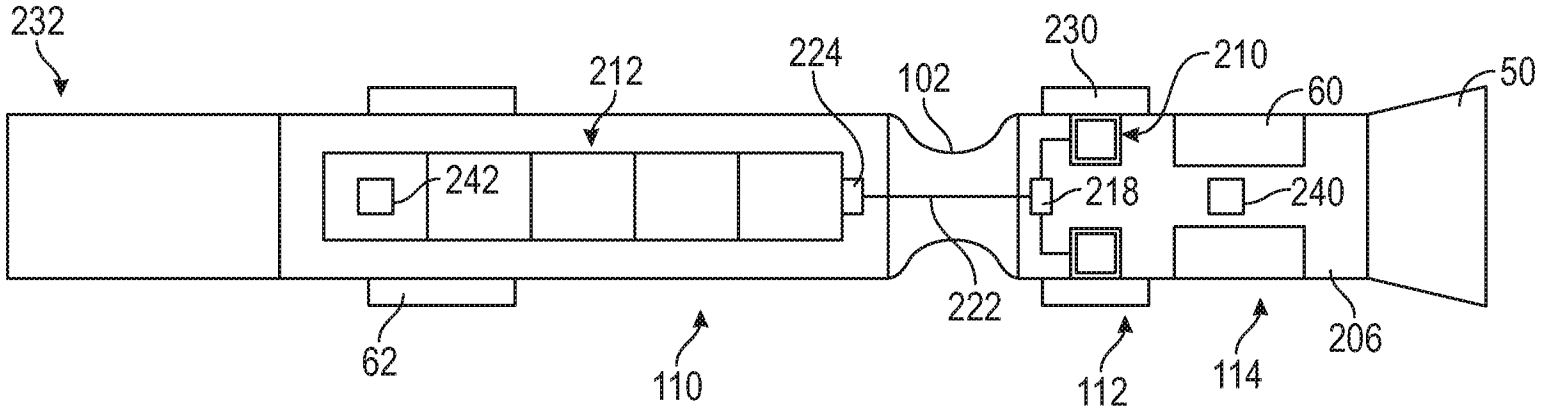
FIG. 3A is a schematic view of an RSS having a flexible collar coupled between a steering section and a control section thereof.

FIG. 3A is a schematic view of an RSS 200 having the flexible collar 102 between the steering section 114 and control section 110 of the RSS 200. This arrangement may be particularly useful when strategic sizing and material selection for the flexible collar 102 are employed to increase or maximize the DLS capability of the RSS 200. The steering section 114 is housed together with the flow control section 112 in a housing 206. The valve assemblies 210 or single rotating valve of the flow control section 112 are disposed in a portion of the housing 206 generally up-hole of the steering pads 60. The control section 110 includes a modular sensor and control electronics assembly 212.

In the arrangement of FIG. 3, the valve assemblies 210, single rotating valve, or other flow control devices in the flow control section 112 may require an electrical connection to the modular sensor and control electronics assembly 212. Where the valve assemblies 210 include a battery or other power source (not shown) contained in the housing 206 of the steering section 114, the valve assemblies 210 may only need instructions to be communicated across the flexible collar 102. The instructions may be received by a communication reception unit 218 of the steering section 114. Where the valve assemblies 210 do not include a power source, the valve assemblies 210 may need to receive instructions as well as power through the flexible collar 102. Instructions and data may be transmitted through a multi-conductor communication cable 222, wire or other electrical conductor extending through the flexible collar 102. A communication transmission unit 224 may be operatively coupled to the modular electronics assembly 212 to receive instructions therefrom, and may be operatively coupled to the communication cable 222 to transmit the instructions therethrough. Since only an electrical communication cable 222 needs to pass therethrough (e.g., no mechanical drive shaft may be necessary), the flexible collar 102 with reduced bending stiffness may be added very close to the drill bit 50, i.e., directly above the steering pads 60.

A leading stabilizer 230 may be provided in the steering section 114, and extends laterally from the housing 206. The leading stabilizer 230 may prevent a portion of the bending moments applied to a drill string 20 (FIG. 1) extending through a curved borehole from being reacted at the steering pads 60. These bending moments have been found, in some instances, to cause the steering pads 60 to retract into the housing 206, thereby preventing effective steering of the drill bit 50. The leading stabilizer 230 may be disposed adjacent or above the steering pads 60, and may protrude from the same housing 206 as the steering pads 60.

A power section 232 is provided above the control section 110. The power section 232 may include turbine blades (not shown) that extract energy from drilling mud 31 (FIG. 1) pumped down the drill string (FIG. 1) to generate electrical power for the electronics assembly 212, communication transmission unit 224, communication reception unit 218 and the valve assemblies 210. The valve assemblies 210 or single rotating valve may rely on an electric motor (not shown) for selectively providing drilling mud to the steering pads 60.

In case flexing is not required, a flex collar 102 could become a possible future upgrade. In some embodiments, the flexible collar 102 could also be used to mount sensors to measure and record drilling parameters such as weight on bit (WOB), torque on bit (TOB), and bending loads; important data that can be used as for directional control. In order to increase the steerability and response of the RSS 200, a selection of direction and inclination sensors may be placed below the flexible collar 102, e.g., in the steering section 114 to provide an early indication of directional output. A flexible collar 102 may be designed, constructed and positioned within the RSS 200 to make the RSS 200 highly agile and provide a high DLS capability. Near bit direction; and/or inclination measurement data may be provided by a dynamic measurement package 240 in the steering section 114 or the flexible collar 102 (see FIG. 4) for measurement of the direction and/or inclination of the drill bit 50 and/or other characteristics of a drilling operation. A survey grade sensor package 242 may be provided in the control section 110 for providing MWD and/or LWD capabilities. The near bit measurements can be of a lower quality and will be combined with the higher quality direction and inclination (D&I) data from the control section to make steering decisions.

As indicated above, the control section 110 features a modular electronics assembly 212 including sensor packages for D&I, GR, and others as well as CPU, power conditioning, and communication. The power generation/supply module section is also generally located inside the Control Section 110. In order to allow easy diagnostics and maintenance a high degree of modularity is very desirable combined with onboard diagnostics and memory on each module to allow fault finding, service life tracking and accumulative run history capture.

The steering section 114 may include a set of at least three externally mounted actuator assemblies or steering pads 60 that exert force against the wellbore 26 (FIG. 1) in a controlled orientation to deviate the drill bit 50 in the desired direction for steering. The steering pads 60 may be energized by a small percentage of the drilling fluid or mud 31 (FIG. 1) pumped through the drill string 20 (FIG. 1) and drill bit 50 for cuttings removal, cooling and well control. The RSS 200 is thereby using the "free" hydraulic energy of the drilling fluid for directional control. The actuator assemblies or steering pads 60 may be piston assemblies, hinged pads or energized stabilizer blades in various embodiments. By utilizing the "free" hydraulic energy of the drilling fluid pumped through the drill string 20, only the energy to control the fluid flow needs to be provided. For traditional electrical servomotor/solenoid-type drive systems, the power requirement is in the order of 100-300 W. Electromechanical material based actuators offer a significantly reduced power requirement, low heat generation, a design with no moving parts that require hermetic sealing and oil filling and related compensation systems, low wear rates, high stiffness, a proportional response and a very compact design. Compared to the power requirements of traditional electrical drive systems (100-300 W) the power requirement of an electromechanical material based flow control device 210 could be as low as 10 W, or lower. The low power consumption combined with compact design should allow flow control devices 210 to be mounted externally to the steering section 114 in close proximity to the steering pads 60. This reduces the need for expensive gun drilling operation to create flow paths in the RSS 200 to port the drilling fluid or mud to the steering pads 60. Alternately, a single rotating valve can distribute flow to the steering pads 60 through a manifold and gun drilled ports.

In another embodiment the flow control devices 210 are located inside the steering pads, e.g., inside a piston assembly operable to drive the steering pads 60. The compact design offers a key advantage in that it allows the control electronics and sensors 240 used for directional control to move much closer to the drill bit 50, which allows for a better directional control. In other embodiments, the RSS 200 can be equipped with a compact and self-contained module for a traditional flow-control section 112, within or attached to the steering section 114.

Figure 3B:
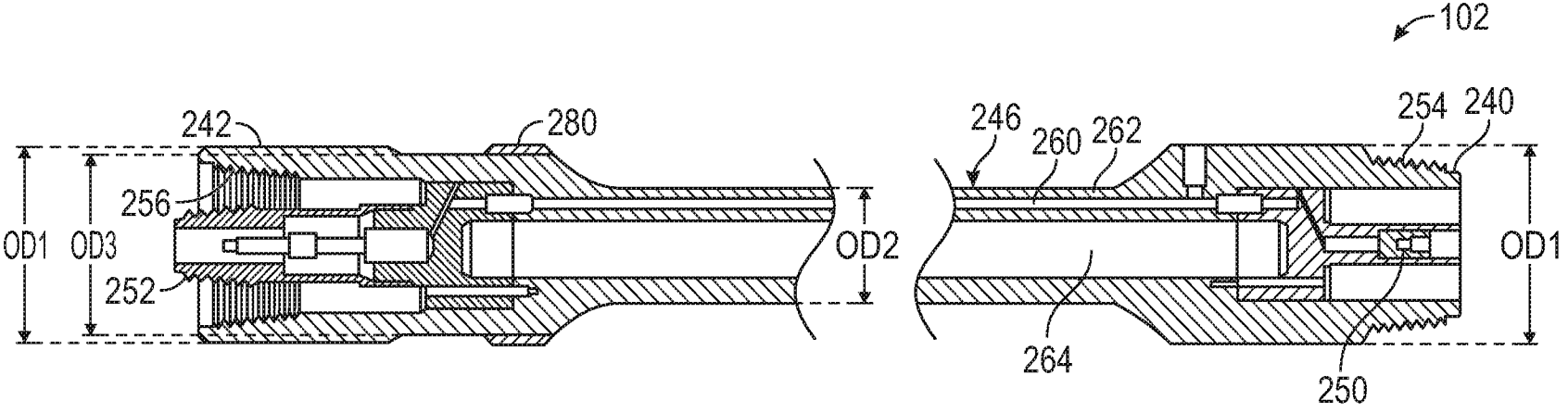
FIG. 3B is a cross sectional view of the flexible collar of FIG. 3A

FIG. 3B is a cross-sectional view of the flexible collar 102. The flexible collar 102 generally defines a first outer diameter OD1 at leading end 240 and a trailing end 242 thereof. The first outer diameter OD1 may be similar to the outer diameters of the housings 122 (FIG. 2) and 206 (FIG. 3A) of the control section 110 and steering section 114. A necked down portion 246 between the leading and trailing ends 240, 242 defines a second outer diameter OD2 that is less than the first outer diameter OD1. The necked down portion 246 provides a reduced bending stiffness to the flexible collar 102. In other embodiments, the flexible collar 102 can be implemented in forms other than a traditional necked down collar. For example, the flexible collar 102 may be a generally cylindrical tubular member e.g., the first and second outer diameters OD1, OD2 (and a third outer diameter OD3) may all be equal. A hard-faced wear band or stabilizer (280) may be provided on OD3 to prevent excessive wear in case of contact with borehole 26, or to limit lateral deflection of the trailing end 242 of flexible collar 102 within borehole 26. In other embodiments, the flexible collar may be configured as a fully articulated universal joint. In the case of a fully articulated universal joint, the joint may be defined on an exterior of the housing such that the entire outer diameter of the flexible collar below the joint articulates. The lower the bending stiffness of the flexible collar 102 or flex section, the more the RSS 200 (FIG. 3A) behaves like a point-the-bit rotary steerable system with the potential of achieving very high dogleg severities.

Data and power transmission through the flexible collar 102 can be achieved in a variety of ways, e.g., a wired extender running through the flexible collar 102, electrical conductors attached to or integrated with the flexible collar 102 or even wireless power/data transmission over a short distance. As illustrated in FIG. 3B, the flexible collar 102 includes electrical connectors 250, 252 at the leading and trailing ends 240, 242 to facilitate coupling the flexible collar 102 to other sections 110, 112, 114, 232 of the RSS 200. The connectors 250, 252 may comprise rotary connectors, e.g., connectors that may engage corresponding connectors in other RSS sections 110, 112, 114, 232 of by relative rotational movement therebetween. In some embodiments, structural connectors 254, 256 such as threads may be provided for coupling the flexible collar 102 to other sections 110, 112, 114, 232, such that the relative rotational motion establishes both structural and electrical connections between the flexible collar 102 and the other sections 110, 112, 114, 232. In some embodiments, the connectors 250, 252 may comprise 8-pin rotational connectors to accommodate the data and power transmission through the flexible collar 102. Depending on the power requirements of the flow control section, a small battery or compact power generation module, e.g., vibration based, could be included. In that case only data transmission would be required facilitating a wireless flexible collar 102.

The connectors 250, 252 may be operably coupled to one another with electrical cable 222 (FIG. 3A). In some embodiments, a gun-drilled longitudinal bore 260 may be provided through a wall 262 of the flexible collar 102. The longitudinal bore 260 may be radially offset from a primary flow passage 264 extending through the flexible collar 102.

The flexible collar 102 could be made replaceable and/or repositionable among the sections 110, 112, 114, 232 of the RSS 200 to configure the RSS 200 based on a required steering response. Detailed modeling may be performed to determine if a particular flexible collar 102 or flex section is necessary to achieve the required dogleg severity for a particular project. For example, the required dogleg severity may be a consideration in selecting a flexible collar from a source of available flexible collars 102, or a flexible collar 102 may be constructed according to a sizing and material selection based on the required dogleg severity for the project. In some embodiments, a drill bit 50 (FIG. 3A) may also be selected and/or constructed to provide a necessary side cutting efficiency to accommodate or complement a particular configuration and arrangement of a flexible collar 102 in an RSS 200. Side-cutting efficiency of the drill bit refers to the ability of the drill bit to drill laterally as a ratio of the ability of the drill bit to drill axially. Side-cutting efficiency (SCE) may be defined as:

$$SCE = \frac{(\text{Rate of Lateral Penetration} \div \text{Side Force At the Bit})}{(\text{Rate of Axial Penetration} \div \text{Axial Weight on Bit})}$$

The typical range of SCE for a PDC drill bit is 0.01 to 0.50. In some examples, if it is determined that an RSS 200 having a particular arrangement is capable of providing a greater DLS capability than necessary, a drill bit 50 having a relatively low side cutting efficiency may be selected in order limit the DLS capability to improve the durability or reliability of the RSS 200. For example, a drill bit 50 having a relatively low side cutting efficiency may be selected to ensure that the flexible collar 102 bends only to a predetermined percentage of its capability along the planned path of a wellbore 26 (FIG. 1). Alternately, if it is determined that an RSS 200 having a particular arrangement is not capable of providing the desired DLS capability, a drill bit 50 having a relatively high side cutting efficiency may be selected in order to achieve the drilling objectives.

Figure 4:
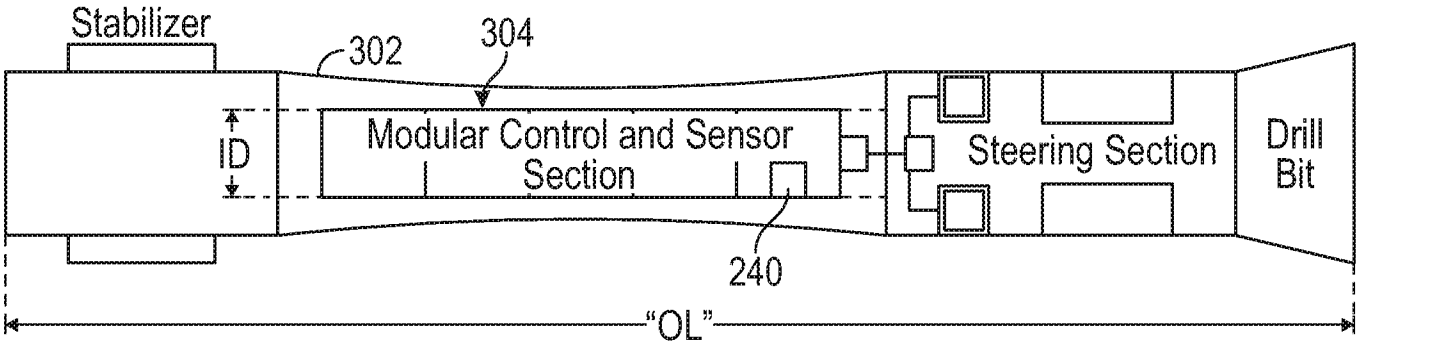
FIG. 4 is a schematic view of an RSS having a flexible collar wherein control components are disposed within a flexible collar.

FIG. 4 is a schematic view of an RSS 300 having a flexible collar 302 wherein control components 304 are disposed within a flexible collar 302. The control components 304 may include any of the equipment described above for the electronics assembly 212 (FIG. 3A) and any other modular control assemblies for operating the RSS 300. Using some of the material selection and strategic sizing techniques discussed below, the inner diameter ID of the flexible collar 302 may be sufficiently increased for some applications to accommodate the modular control assemblies 304 as well as provide sufficient fluid flow therethrough. This arrangement may reduce an overall length OL of the RSS 300 for some applications. As illustrated in FIG. 4, the flexible collar 302 is illustrated schematically as including a necked down section, but as described above, generally cylindrical or other configurations are contemplated as well.

In some of the embodiments described herein, a push-the-bit rotary steerable concept is described with a flexible collar 102, 302 between the steering section 114 and the control section 110 of the RSS to improve the turning radius capability. The strategic sizing and material selection of the flexible collar 102, 302 may further improve the turning radius capability, or limit this capability when desired. As the flexible collar 102, 302 is made more flexible, the dogleg severity (DLS) capability of the RSS is increased. A high DLS capability is desirable for many oil and/or gas wellbores 26 (FIG. 1). For example, a short curve length on a build section can maximize the amount of reservoir exposure of a subsequent lateral production section. Other applications may require a high DLS capability such as: avoiding other wellbores; achieving a desired DLS capability in a problematic formation by selecting a configuration that normally provides a higher than needed DLS capability to compensate for unconsolidated rock, low rock strength, overgauge borehole, formation trends, formations faults or other formation problems; avoiding or exiting problematic or undesirable geologic formations; or drilling sidetrack sections from an existing wellbore 26.

Many oil and/or gas wells do not require a high DLS capability. In these instances, the flexible collar 102, 302 may be made stiffer (and therefore more stable), and the DLS capability of the RSS may be decreased. It may be desirable to run a stiffer RSS with a lower DLS capability to avoid creating or reduce creation of ledges or short segments of locally high DLS that are sometimes generated by the use of high DLS capable tools while trying to drill a low DLS segment, e.g., straight in vertical, tangent, lateral or horizontal sections of a wellbore. In addition, high DLS capable systems are less stable and may generate wellbore oscillations or spiraling, which may be avoided by using a relatively stiff flexible collar 102, 302.

The strategic selection of the side-cutting efficiency of drill bit 50 may be used in conjunction with the sizing and material selection of the flexible collar 102, 302 to achieve the desired results. In some instances, a drill bit 50 with a relatively high side-cutting efficiency may be selected for use with a particular flexible collar 102, 302. For example, when maximum DLS capability is desired, a maximum flexibility flexible collar 102, 302 may be combined with a drill bit 50 having maximum SCE, subject to other constraints such a stress, rate of penetration, etc. In some instances, a drill bit 50 with a relatively low side-cutting efficiency may be selected for use with a particular flexible collar 102, 302 arrangement to limit the DLS capability of an RSS 58, 200, 300. For example, the selection of a drill bit 50 having a relatively low side-cutting efficiency may be selected to prevent the flexible collar 102, 302 from flexing to its capacity in operation. This may improve the stability of an RSS 58, 200, 300 and limit many of the undesirable features of wellbores. Ledges, local high DLS, and well bore oscillations or spiraling create drag that limits the length of tangent, lateral or horizontal sections of a wellbore. These undesirable features can also make it difficult to run liners, casing, and completions equipment in or out of a wellbore. In some instances, a drill bit 50 with relatively high side-cutting efficiency may be selected to enhance the DLS capability of a relatively stiff flexible collar 102, 302. The relatively stiff flexible collar 102, 302 may be desired to limit vibration or torsional oscillations and yet still achieve a desired DLS objective with a higher SCE drill bit 50. The full range of stiffness of the flexible collar 102, 302 along with the full range of SCE of drill bit 50 may be considered together when strategically selecting the OD, ID, length and material of the flexible collar 102, 302 and the SCE of drill bit 50 to achieve the desired DLS and other wellbore objectives.

For at least the reasons articulated above, it is desirable to strategically select the configuration of an RSS 58, 200, 300 and SCE of drill bit 50 to match the needs of the wellbore 26 being drilled. By selecting an appropriate combination of the OD, ID, length, material of the flexible collar, the position of the flexible collar 102, 302 within the BHA 22, and/or a side cutting efficiency of a drill bit 50 for use with the BHA 22, the needs of the wellbore 26 may be accommodated. The selection of these parameters may also provide other benefits including providing a more desirable length, bending stiffness, bending stress, torsional stiffness, shear stress due to torsion, and increased DLS tolerance as discussed below.

Figures 5A, 5B:
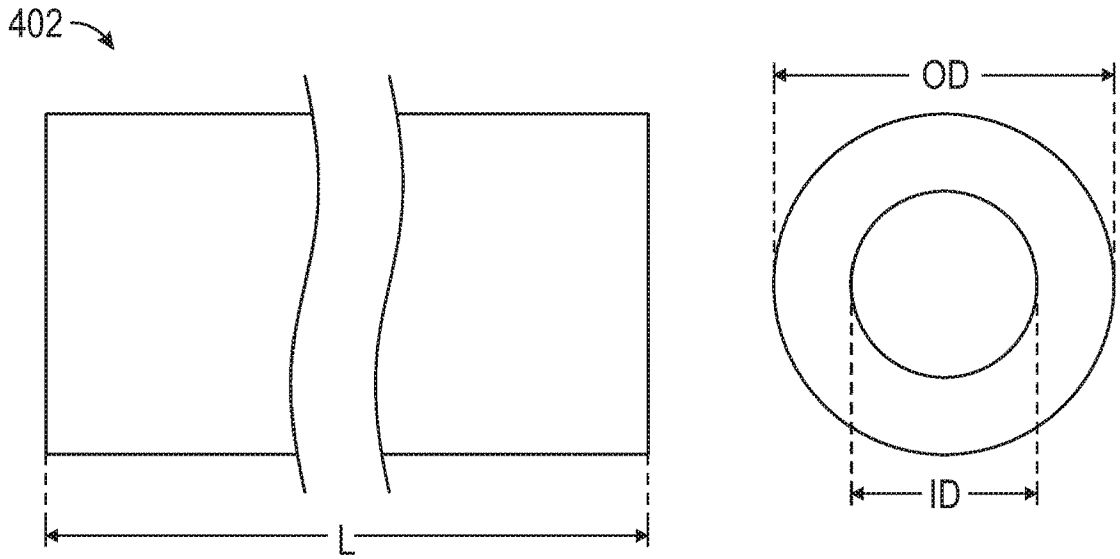
FIG. 5A is schematic illustration of an example flexible collar having a generally cylindrical configuration.
FIG. 5B is table illustrating geometric and stiffness characteristics of two example flexible collars configured as the flexible collar of FIG. 5A and constructed of different materials (steel and titanium)

Referring to FIG. 5A, an example flexible collar 402 is described having a generally cylindrical configuration. The flexible collar has a length (L), an inner diameter (ID) and an outer diameter (OD). Although flexible collar 402 exhibits a simplified geometry, the principles discussed below with reference to flexible collar 402 also apply the more complex geometries of the flexible collars 102, 302 described above. Generally speaking, increasing flexibility of the flexible collar 402 may be achieved by one or more of the following: (1) Decreasing the outer diameter (OD), (2) increasing the inner diameter (ID), (3) increasing the length (L) and (4) decreasing modulus of elasticity (E) of the flexible collar 402. Conversely, increasing stiffness of the flexible collar 402 may be achieved by one or more of the following: (1) increasing the outer diameter OD, (2) decreasing the inner diameter ID, (3) decreasing the length (L), and (4) increasing the modulus of elasticity (E) of the flexible collar 402.

Creating the desired outer diameter (OD), inner diameter (ID) and length (L) can be achieved by conventional machining, casting or forging techniques when a metallic material is selected. Non-metallic materials such as composites, fiberglass, plastics, etc. can also be produced with the combination desired outer diameter (OD), inner diameter (ID), length (L) and modulus of elasticity (E). Modulus of elasticity (E) is a physical mechanical property of the material, and thus can thus be selected by choice of material. In the case of composites or some other non-metallic materials, the physical construction of the material itself may be manipulated to provide a desired modulus of elasticity (E).

Non-limiting examples of conventional metallic materials used in downhole tool applications with representative values of modulus of elasticity include: Steel or Stainless Steel ($28\text{-}30\times10^6$ psi); Beryllium Copper ($19.5\times10^6$ psi); Titanium ($13.9\text{-}19\times10^6$ psi); and Aluminum ($10\times10^6$ psi), austenitic nickel-chromium-based alloys such as Inconel 718 ($29.6\times10^6$ psi). In some applications, Magnesium materials may be selected.

FIG. 5B is table illustrating geometric and stiffness characteristics of two example flexible collars $\mathbf{402}_{Ti}$, $\mathbf{402}_{Sd}$ constructed of different materials (steel and titanium) illustrating how a particular DLS capability of the RSS 58 (FIG. 1) may be provided by appropriately selecting available design parameters. In the example illustrated in FIG. 5B, the titanium and steel flexible collars $\mathbf{402}_{Ti}$, $\mathbf{402}_{Stl}$ have the same length (L). The titanium flexible collar $\mathbf{402}_{Ti}$, however, exhibits a much larger (OD) and (ID) than the steel flexible collar $\mathbf{402}_{Stl}$, and therefore provides a much larger Area Moment of inertia (I). If the two materials had the same Modulus of Elasticity (E), the Area Moment of Inertia (I) indicates the titanium flexible collar $\mathbf{402}_{Ti}$ would be 43% stiffer than the steel flexible collar 402. However, the Modulus of Elasticity (E) of the titanium collar $\mathbf{402}_{Ti}$ is only 48% of the steel flexible collar $\mathbf{402}_{Stl}$. Since the length (L) of the flexible collars $\mathbf{402}_{Ti}$, $\mathbf{402}_{Stl}$ is the same, the net stiffness may be represented by E×I. The net effect is that the titanium flexible collar $\mathbf{402}_{Ti}$ is only 69% as stiff as the steel flexible collar $\mathbf{402}_{Stl}$. The steel flexible collar $\mathbf{402}_{Stl}$ is much stiffer than the titanium flexible collar $\mathbf{402}_{Ti}$ even though the outer diameter (OD) and inner diameter (ID) are much smaller.

Figure 6:
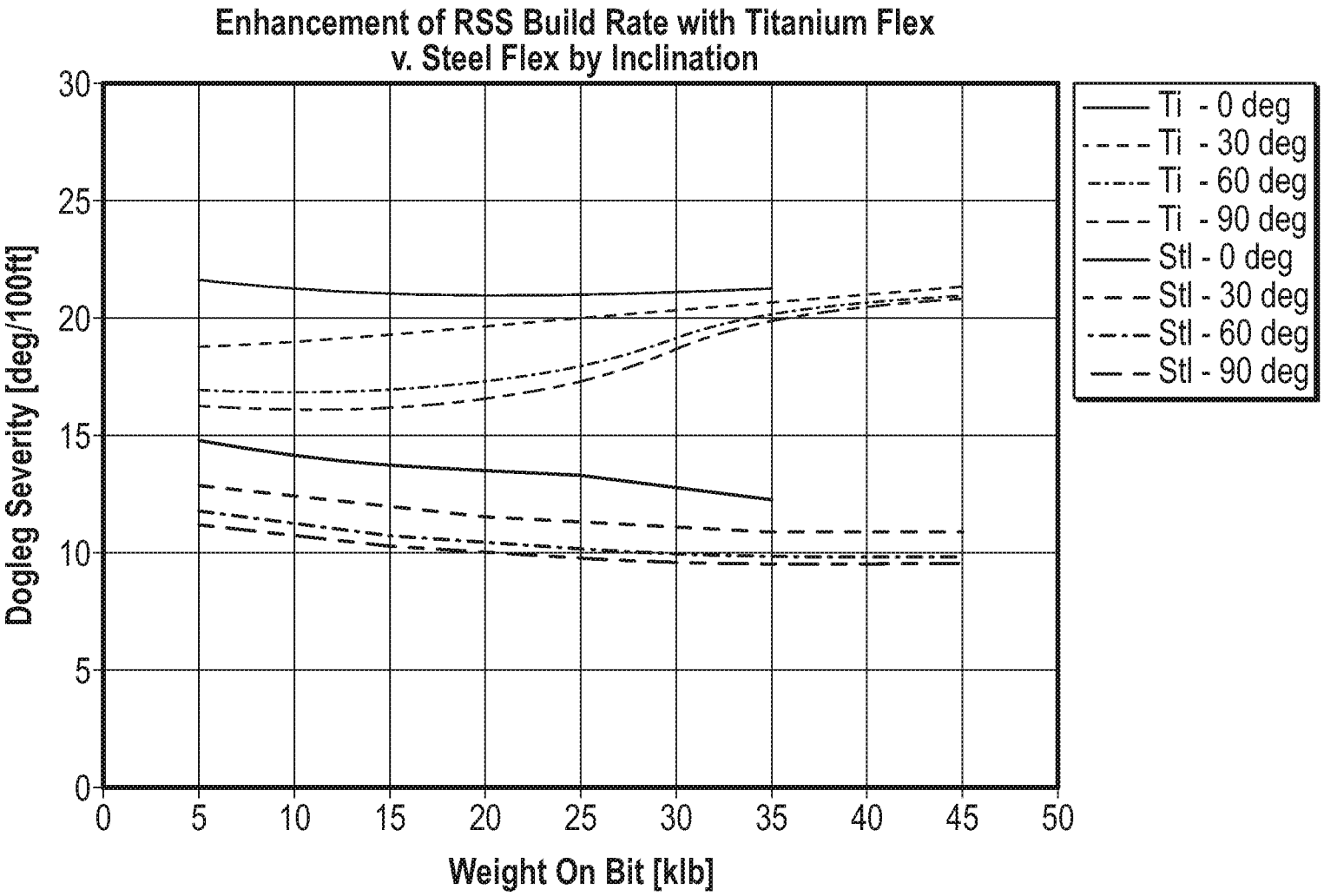
FIG. 6 is a graphical view illustrating the dogleg severity achievable with the two example flexible collars of FIG. 5B as a function of weight on bit at a variety of inclinations illustrating improved build rate capabilities.
Figure 7:
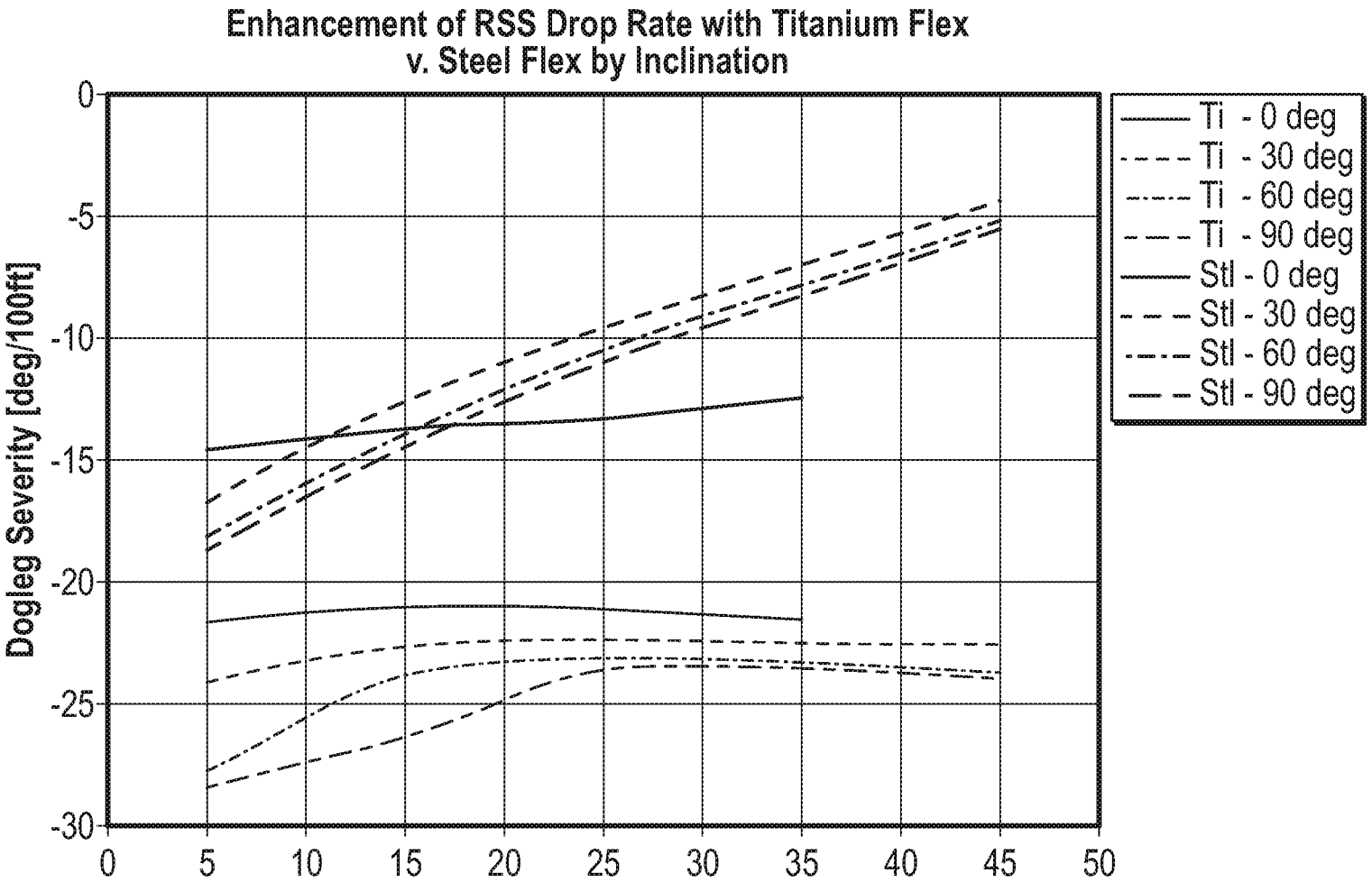
FIG. 7 is a graphical view illustrating a the dogleg severity achievable with the two example flexible collars of FIG. 5B as a function of weight on bit at a variety of inclinations illustrating improved drop rate capabilities.

FIGS. 6 and 7 illustrate the effect of these two flexible collars $\mathbf{402}_{Ti}$, $\mathbf{402}_{Stl}$ and the dissimilar associated stiffness on the DLS capability of the RSS 58. In FIG. 6, the Build Rate or dogleg severity (DLS), is shown for the two different stiffness flexible collars as a function of Weight-On-Bit (WOB) at a variety of inclinations (0 degrees, 30 degrees, 60 degrees and 90 degrees). In FIG. 7 the Drop Rate is shown as a function of WOB. The build rate generally relates to the DLS in the vertical plane as inclination is increasing with depth and the drop rate generally relates to the DLS in the vertical plane as inclination is decreasing with depth.

In the example illustrated in FIG. 6, the titanium flexible collar $\mathbf{402}_{Ti}$ provides about 5 to 11 degrees per 100 ft. greater build rate capability than the steel flexible collar $\mathbf{402}_{Stl}$ across the range of WOB and inclination because it is more flexible (it is 69% as stiff as the steel flexible collar $\mathbf{402}_{Stl}$). As illustrated in FIG. 7, for this particular example the titanium flexible collar $\mathbf{402}_{Ti}$ has a 7 to 18 deg/100 ft greater drop rate over the steel flexible collar $\mathbf{402}_{Stl}$ across the range of WOB and inclination because it is more flexible, being only 69% as stiff.

From the examples illustrated in FIGS. 5A-7, it may be demonstrated that the selection of a material for the flexible collar with a lower modulus of elasticity (E) than steel may provide a greater flexibility to achieve higher DLS capabilities. Materials with a lower modulus of elasticity (E) than steel include, but are not limited to, titanium, beryllium copper, and aluminum. Additional improvements over the steel flexible collar may also be realized from a selection of a titanium material as illustrated in FIGS. 5-7.

For example, a reduced overall length "OL" (see FIG. 4) of a tool may be realized, or relatively short RSS 58, may be provided with a titanium flexible collar $\mathbf{402}_{Ti}$ or a flexible collar constructed of dissimilar materials with respect to a steering section of the RSS 58. The titanium flexible collar $\mathbf{402}_{Ti}$ in the example of FIGS. 5-7 enables a larger inner diameter (ID) than the steel flexible collar $\mathbf{402}_{Stl}$. With the smaller inner diameter (ID) of the steel flexible collar $\mathbf{402}_{Stl}$, it may be impractical to run electronics/control modules e.g., control components 304 (see FIG. 4) in the flexible collar $\mathbf{402}_{Stl}$ due to the size required for the modules, the space needed for supports/centralizers between the modules and the inner diameter (ID) of the collar $\mathbf{402}_{Stl}$, and the flow area needed between the modules and the inner diameter (ID) of the collar $\mathbf{402}_{Stl}$ (and in particular the flow area through the supports/centralizers). Thus, with a steel flexible collar $\mathbf{402}_{Stl}$, wires or cables 222 may extend through the length of the flexible collar to electrically connect the control module section and the steering section (see, e.g., FIG. 3A, not to scale). With the larger inner diameter (ID) that the titanium flexible collar $\mathbf{402}_{Ti}$ enables, it may be practical to run the electronics/control components 304 within the flexible collar $\mathbf{402}_{Ti}$ (see, e.g., FIG. 4, not to scale). The length that would be consumed by the wires or cables 222, can be used by the control components 304 or any other electronics module desired. The overall length "OL" of the RSS 300 can be significantly reduced.

By selecting titanium for construction of the flexible collar $\mathbf{402}_{Ti}$, a reduced bending stiffness and bending stress may also be realized. Bending moment is proportional to (E×I)/radius of curvature, e.g., the smaller the radius of curvature, the larger the bending moment. Radius of curvature is inversely proportional to DLS, e.g., the larger the DLS the smaller the radius of curvature. Hence, bending moment is proportional to (E×I)×DLS. For a given DLS, a reduction in (E×I) is enabled by the titanium flexible collar $\mathbf{402}_{Ti}$, hence a reduction in bending moment.

Bending stress is proportional to bending moment×(OD/2)/I. Thus, bending stress is proportional to (E×I)×DLS×(OD/2)/I. Because "I" appears both in the numerator and denominator it divides out and, hence, bending stress is proportional to E×DLS×(OD/2). In the example, the titanium flexible collar 402$_{Ti}$ lowers modulus of elasticity (E), but increases the outer diameter (OD). As long as the reduction in the modulus of elasticity (E) is proportionately larger than the increase in outer diameter (OD), bending stress is reduced, as enabled by the titanium flexible collar 402$_{Ti}$. Lower bending stress is very desirable in RSS applications.

By selecting a titanium flexible collar 402$_{Ti}$, decreased torsional stiffness and reduced shear stress due to torsion may also be realized. Torsional stiffness is proportional to (J×G)/Length of the flexible collar 402$_{Ti}$, where J represents the polar moment of inertia and G represents the modulus of rigidity. For a given length (L), in this specific example the titanium flexible collar 402$_{Ti}$ reduces torsional stiffness (e.g., J×G is lower for the titanium flexible collar 402$_{Ti}$), which is not necessarily desirable in all instances. Some optimization can occur with length (L) by reducing the length (L) of the titanium flexible collar 402$_{Ti}$ to increase the torsional stiffness balanced against the increase in bending stiffness and bending stress.

However, shear stress due to torsion is proportional to Torque×(OD/2)/J. The titanium flexible collar 402$_{Ti}$ enables a larger value of J, hence a lower shear stress due to torsion, even as OD increases because J is a function of $OD^4$. Reduced shear stress due to torsion is very desirable in RSS applications.

An increased DLS tolerance may also be realized by selecting the titanium flexible collar 402$_{Ti}$. As shown in the example of FIGS. 5-7, decreasing stiffness using the titanium flexible collar 402$_{Ti}$ increases the DLS capability. But because of the lower bending stress at a given DLS, the titanium flexible housing 402$_{Ti}$ enables a higher DLS to be tolerated.

Figure 8:
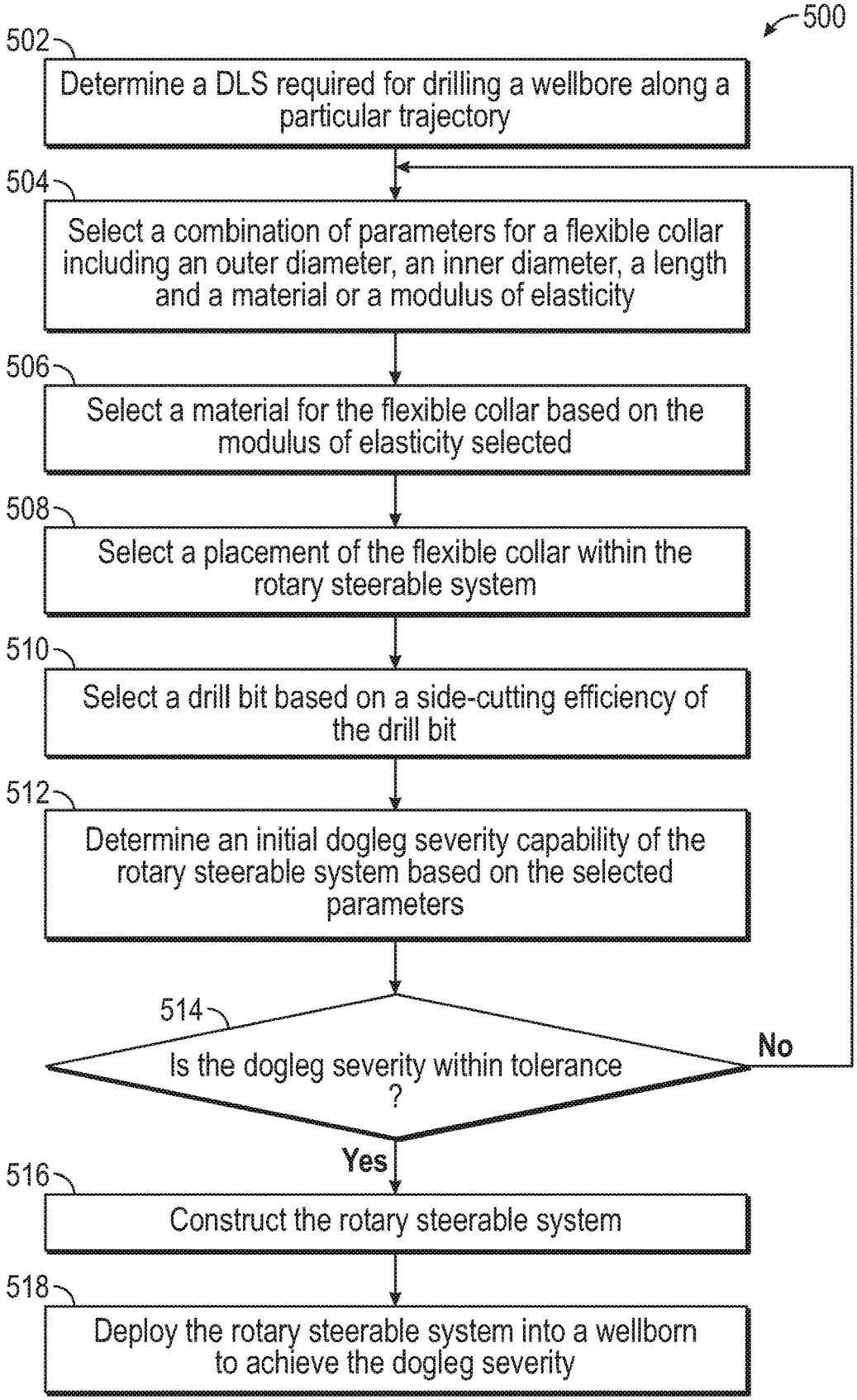
FIG. 8 is a flowchart illustrating a process of configuring and constructing a rotary steerable system.

Referring to FIG. 8, a procedure 500 for configuring and constructing a rotary steerable system is described. Although the steps described below may be performed in the order illustrated in FIG. 8, at least some of the steps may be performed in a different order without departing from the scope of the disclosure. At step 502, a maximum DLS required for drilling a wellbore is determined. The required or maximum DLS may include, e.g., the largest build rate or drop rate in a planned wellbore path or trajectory of the wellbore.

At step 504, a selection of a combination of parameters for a flexible collar is made based on the required DLS. For example, the combination of parameters may be selected to provide the rotary steerable system with sufficient flexibility to achieve the maximum dogleg severity. The parameters include geometrical parameters, e.g., an outer diameter (OD), an inner diameter (ID), a length (L) of the flexible collar. The parameters may also include the material parameters, e.g., modulus of elasticity (E). A material is selected for the flexible collar based at least in part on the modulus of elasticity (E) selected (step 506). In some embodiments, the material selected for the flexible collar may be dissimilar from a material of other sections in the RSS. For example, housings for a control section 110, flow control section 112 and a steering section 114 may be constructed of steel, while Titanium or Inconel 718 may be selected for the flexible collar.

At step 508, a placement of the flexible collar within the rotary steerable system is selected. Where the required DLS is relatively high, a placement of the flexible collar between a steering section and a control section may be complemented. Where the required DLS is relatively low, or where stability is a significant concern, a placement of the flexible collar at an up-hole end of a control section 110 may be contemplated. Next, a drill bit may be selected for use with the RSS (step 510). A side cutting efficiency to of the drill bit may be a consideration in the selection. Where the required DLS is relatively high, a relatively high side cutting efficiency may be selected, which may permit the flexible collar to reach its flexural capacity in operation. Where the required DLS is relatively low, a drill bit having a relatively low side cutting efficiency may be selected, which may limit the flexing of the flexible collar in operation. The DLS capability with a relatively stiff flexible collar may be enhanced by a relatively high SCE drill bit. The DLS capability with a relatively limber flexible collar may be tempered by a relatively low SCE drill bit.

Once the parameters and an arrangement of the RSS are all selected, at step 512 an initial dogleg severity capability of the RSS may be determined based on the selected placement, material, and combination of parameters for the flexible collar. In some embodiments, the initial DLS capability is determined mathematically, e.g., using finite element analysis models and techniques. In other embodiments, the DLS capability is determined empirically by constructing a RSS according to the selected parameters and observing the capability achieved in a test or actual working wellbore.

Next, the procedure 500 proceeds to decision 514 where the initial DLS capability is compared to a predetermined tolerance for the DLS capability. If it is determined that the initial DLS capability is sufficiently close to DLS severity required, the procedure 500 may proceed to step 516 where the RSS and/or drill bit are constructed based on the initial selected placement and parameters of the flexible collar, and/or drill bit SCE, and then deploying the RSS into a wellbore (step 518) with the selected drill bit.

If at the decision 514, it is determined that the initial DLS capability is not within the predetermined tolerance, the procedure 500 may return to step 504 (or any of steps 506, 508, 510), where adjusted selections may be made. An adjusted placement, material and combination of parameters may be made that yields an adjusted dogleg severity capability that is more proximate the dogleg severity required than the initial dogleg severity capability. In some embodiments, where the DLS capability determined in step 512 is insufficient, an adjusted modulus of elasticity (E) may be selected that is lower than the initial modulus of elasticity (E) selected to yield a more flexible DSS. Conversely, where the DLS capability determined in step 512 is greater than necessary to accommodate the DLS severity required, a drill bit having a lower side cutting efficiency may be selected to improve the stability and/or durability of the RSS. The procedure 500 may repeat iteratively until the DLS capability determined is within tolerance.

Thereafter, the RSS and/or drill bit may be constructed based on the adjusted placement, material and combination of parameters (step 516) and the RSS may be deployed into the wellbore to achieve the dogleg severity required with the adjusted drill bit.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

In one aspect, the disclosure is directed to a method of configuring a rotary steerable system. The method includes (a) determining a maximum dogleg severity required for drilling a wellbore along a planned wellbore path, (b) determining a combination of parameters for a flexible collar to provide the rotary steerable system with sufficient flexibility to achieve the maximum dogleg severity, the parameters including an outer diameter, an inner diameter, a length and a modulus of elasticity, (c) selecting a material for the flexible collar based on the modulus of elasticity determined, and (d) assembling the rotary steerable system with the flexible collar having to the combination of parameters and selected material.

In some embodiments, the method further includes selecting a drill bit having a side cutting efficiency determined to cause the flexible collar to bend a predetermined percentage of a bending capability or capacity of the flexible collar at the maximum dogleg severity along the planned wellbore path, and assembling the rotary steerable system with the drill bit. The side cutting efficiency selected may be determined to limit a DLS capability of the rotary steerable system.

In one or more exemplary embodiments, the method may further include selecting a placement of the flexible collar with respect to a steering section and a control section of the rotary steerable system. In some embodiments, the placement of the flexible collar is selected to be between a steering section and a control section of the rotary steerable system. The material selected for the flexible collar may be dissimilar from materials of the steering section and control section. In some embodiments, the material selected includes at least one of the group consisting of titanium, austenitic nickel-chromium-based alloys, and berriluim copper.

In some example embodiments, the combination of parameters is determined to provide a desired tool length for the RSS. The combination of parameters may also be determined to provide a bending stiffness or bending stress desired for the flexible collar, a torsional stiffness or shear stress due to torsion desired for the flexible collar, or a DLS tolerance to be achieved.

In another aspect, the disclosure is directed to a method of configuring and deploying a rotary steerable system. The method includes (a) determining a maximum dogleg severity required for drilling a wellbore along a planned wellbore path, (b) selecting a combination of parameters for a flexible collar, the parameters including an outer diameter, an inner diameter, a length and a modulus of elasticity, (c) selecting a material for the flexible collar based on the modulus of elasticity selected, (d) selecting a placement of the flexible collar within the rotary steerable system (e) determining an initial dogleg severity capability of the rotary steerable system having the selected placement, material, and combination of parameters for the flexible collar, (f) selecting an adjusted placement, material and combination of parameters determined to yield an adjusted dogleg severity capability that is more proximate the maximum dogleg severity required than the initial dogleg severity capability (g) constructing the rotary steerable system based on the adjusted placement, material and combination of parameters, and (h) deploying the rotary steerable system into a wellbore to achieve the maximum dogleg severity required along the planned wellbore path.

In one or more example embodiments, the method further includes selecting a drill bit having a side cutting efficiency determined to cause the flexible collar t bend a predetermined percentage of the adjusted dogleg severity capability at the maximum dogleg severity required along the planned wellbore path. In some embodiments, selecting a drill bit includes selecting a drill bit exhibiting a side cutting efficiency determined to reduce or limit the adjusted dogleg severity capability of the RSS. The method may also include selecting a placement of the flexible collar that is between a steering section and a control section of the rotary steerable system or selecting a placement of the flexible collar at an up-hole end of control section of the rotary steerable system.

In some embodiments, an adjusted modulus of elasticity is selected and an adjusted outer diameter is selected, wherein the adjusted modulus of elasticity is lower than an initial modulus of elasticity and the outer diameter is greater than an initial outer diameter such that the adjusted dogleg severity capability is greater than the initial dogleg severity capability. In some embodiments, the inner diameter of the flexible collar is selected to accommodate a modular control and sensor unit therein. In some embodiments, the initial outer diameter of the flexible collar is selected such that the flexible collar exhibits a necked down portion therein. The adjusted placement, material and combination of parameters may be determined to provide a desired tool length for the RSS, a bending stiffness or bending stress desired for the flexible collar, a torsional stiffness or shear stress due to torsion desired for the flexible collar.

In another aspect, the disclosure is directed to a rotary steerable system. The rotary steerable system includes a drill bit, and a steering section coupled to an upper end of the drill bit. The steering section includes at least one steering pad extendable in a lateral direction to push against a wellbore wall in operation. A control section includes electronics therein for at least one of sensing parameters of a drilling operation and for transmitting instructions to the steering section. A flexible collar is coupled between the steering section and the control section, flexible collar having a lower bending stiffness than the steering section and constructed of a material selected to be dissimilar with respect to a material selected for the steering section.

In some embodiments, the steering section may be constructed of a steel material and the flexible collar may be constructed of an austenitic nickel-chromium-based alloy, titanium, beryllium copper or aluminum material. The control section may include a modular control and sensor unit therein, and wherein the modular control and sensor unit may extend at least partially into the flexible collar.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A method of configuring a rotary steerable system, the method comprising:

determining a maximum dogleg severity required for drilling a wellbore along a planned wellbore path;

determining a combination of parameters for a flexible collar to provide the rotary steerable system with sufficient flexibility to achieve the maximum dogleg severity, the parameters including an outer diameter; an inner diameter, a length and a modulus of elasticity;

selecting a material for the flexible collar based on the modulus of elasticity determined; and assembling the rotary steerable system with the flexible collar having the combination of parameters and selected material.

2. The method according to claim 1, further comprising selecting a drill bit having a side cutting efficiency determined to cause the flexible collar to bend a predetermined percentage of its capability at the maximum the dogleg severity along the planned wellbore path, and assembling the rotary steerable system with the drill bit.

3. The method according to claim 2, wherein the side cutting efficiency is determined to limit a dogleg severity capability of the rotary steerable system.

4. The method according to claim 1, further comprising selecting a placement of the flexible collar with respect to a steering section and a control section of the rotary steerable system.

5. The method according to claim 4, wherein the placement of the flexible collar is selected to be between the steering section and the control section of the rotary steerable system.

6. The method according to claim 5, wherein the material selected for the flexible collar is dissimilar from materials of the steering section and control section.

7. The method according to claim 6, wherein the material selected comprises at least one of the group consisting of titanium, austenitic nickel-chromium-based alloys, and beryllium copper.

8. The method according to claim 7, wherein the material selected comprises titanium.

9. The method according to claim 1, wherein the combination of parameters is determined to provide a desired tool length for the rotary steerable system, a bending stiffness or bending stress desired for the flexible collar, a torsional stiffness or shear stress due to torsion desired for the flexible collar, or a dogleg severity tolerance to be achieved.

10. A method of configuring and deploying a rotary steerable system, the method comprising:

determining a maximum dogleg severity required for drilling a wellbore along a planned wellbore path;

selecting an initial combination of parameters for a flexible collar, the initial combination of parameters including an initial outer diameter; an initial inner diameter, an initial length and an initial modulus of elasticity;

selecting an initial material for the flexible collar based on the initial modulus of elasticity selected;

selecting an initial placement of the flexible collar within the rotary steerable system;

determining an initial dogleg severity capability of the rotary steerable system having the selected placement, material, and combination of parameters for the flexible collar;

selecting an adjusted placement, material and combination of parameters determined to yield an adjusted dogleg severity capability that is more proximate the maximum dogleg severity required than the initial dogleg severity capability;

constructing the rotary steerable system based on the adjusted placement, material and combination of parameters; and deploying the rotary steerable system into the wellbore to achieve the maximum dogleg severity required along the planned wellbore path.

11. The method according to claim 10, further comprising selecting a drill bit having a side cutting efficiency determined to cause the flexible collar to bend a predetermined percentage of the adjusted dogleg severity capability at the maximum dogleg severity required along the planned wellbore path.

12. The method according to claim 11, wherein selecting a drill bit comprises selecting a drill bit exhibiting a side cutting efficiency determined to reduce or limit the adjusted dogleg severity capability of the rotary steerable system.

13. The method according to claim 12, farther comprising selecting the adjusted placement of the flexible collar to be between a steering section and a control section of the rotary steerable system.

14. The method according to claim 10, further comprising selecting the adjusted placement of the flexible collar to be at an up-hole end of a control section of the rotary steerable system.

15. The method according to claim 10, wherein the adjusted combination of parameters includes an adjusted modulus of elasticity and an adjusted outer diameter, wherein the adjusted modulus of elasticity is lower than the initial modulus of elasticity and the outer diameter is greater than the initial outer diameter such that the adjusted dogleg severity capability is greater than the initial dogleg severity capability.

16. The method according to claim 10, wherein the adjusted combination of parameters includes an adjusted inner diameter of the flexible collar selected to accommodate a modular control and sensor unit therein.

17. The method according to claim 10, wherein the initial outer diameter of the flexible collar is selected such that the flexible collar exhibits a necked down portion therein.

18. The method according to claim 10, wherein the adjusted placement, material and combination of parameters is determined to provide a desired tool length for the rotary steerable system, a bending stiffness or bending stress desired for the flexible collar, a torsional stiffness or shear stress due to torsion desired for the flexible collar.

19. A rotary steerable system, comprising:

a drill bit;

a steeling section coupled to an upper end of the drill bit, the steeling section including at least one steering pad extendable in a lateral direction to push against a wellbore wall in operation;

a control section including electronics therein for at least one of sensing parameters of a drilling operation and for transmitting instructions to the steering section; and a flexible collar coupled between the steering section and the control section, the flexible collar having a lower bending stiffness than the steering section and constructed of a material selected to be dissimilar with respect to a material selected for the steering section, wherein the control section includes a modular control and sensor unit therein, and wherein the modular control and sensor unit extends at least partially into the flexible collar.

20. The rotary steerable system according to claim 19, wherein the steering section is constructed of a steel material and wherein the flexible collar is constructed of an austenitic nickel-chromium-based alloy, titanium, beryllium copper or aluminum material.

* * * * *